US005897271A

United States Patent [19]

Widmer

[11] Patent Number: 5,897,271

[45] Date of Patent: Apr. 27, 1999

[54] ROAD REFLECTORS WITH TEMPERATURE DEPENDENT COLOR

[76] Inventor: Timothy S. Widmer, 3201 Columbus St. SE., Albany, Oreg. 97321

[21] Appl. No.: 09/001,718

[22] Filed: Dec. 31, 1997

[51] Int. Cl.[6] ..... G08B 9/06

[52] U.S. Cl. ..... 404/14; 404/1

[58] Field of Search ..... 404/12, 14, 16, 404/1; 428/35.7; 106/21; 374/141; 116/141, 216, 206, 207

[56] References Cited

U.S. PATENT DOCUMENTS

| | | | |
|---|---|---|---|
| 3,922,066 | 11/1975 | Schaefer | 404/12 |
| 4,726,706 | 2/1988 | Attar | 404/14 |
| 4,919,983 | 4/1990 | Fremin | 428/35.7 |
| 5,006,010 | 4/1991 | Duckett | 404/12 |

FOREIGN PATENT DOCUMENTS

| | | | |
|---|---|---|---|
| 2121460 | 4/1988 | United Kingdom | 404/14 |

*Primary Examiner*—Thomas B. Will
*Assistant Examiner*—Rainna Strauss

[57] ABSTRACT

A thermochromatic road marker reflector is provided including a highway marker. A thermochromatic material is mounted on the marker for changing colors in response to a change in temperature.

2 Claims, 2 Drawing Sheets

FIG 1
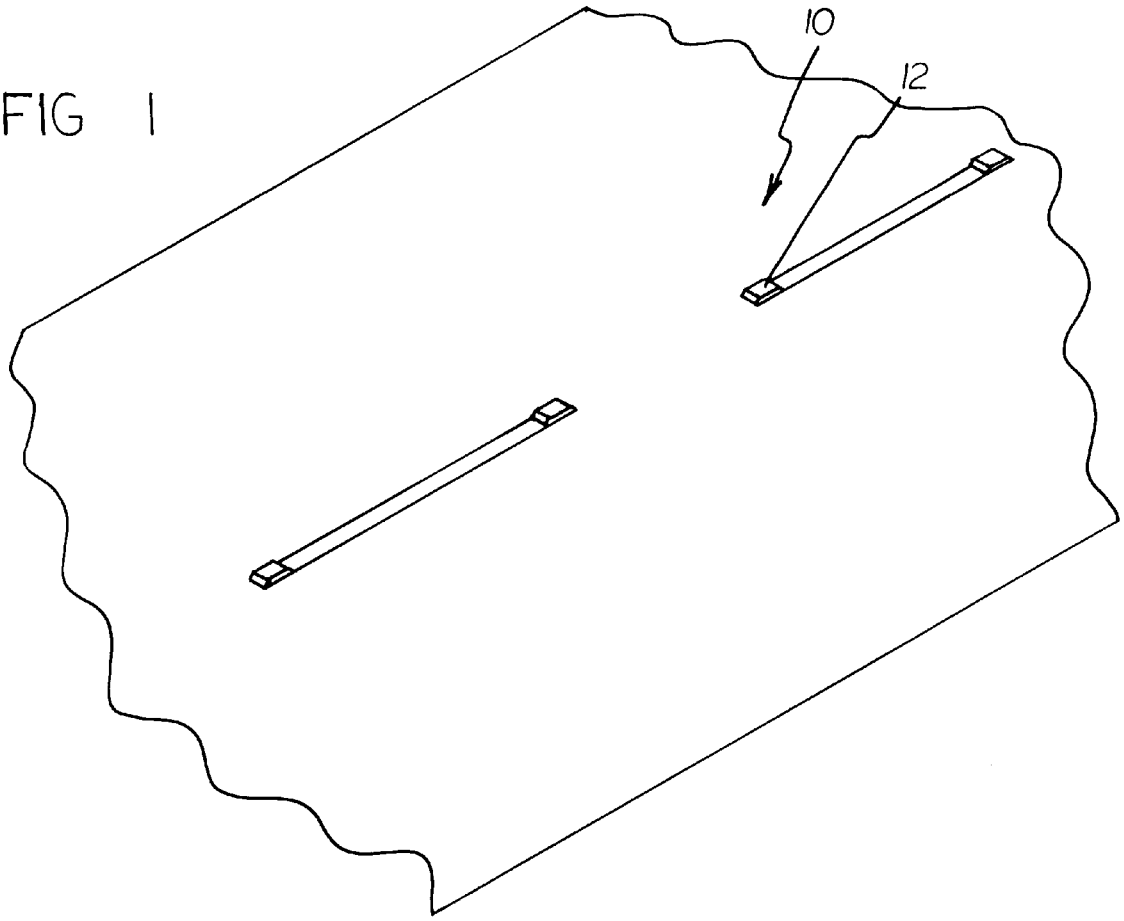
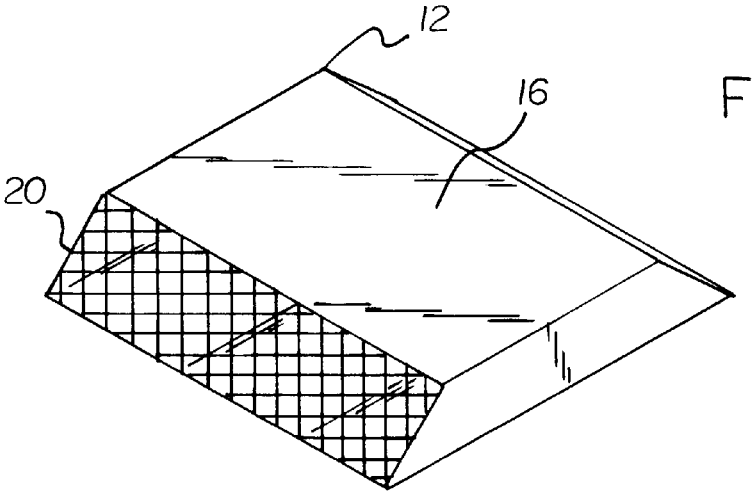
FIG 2

FIG 3
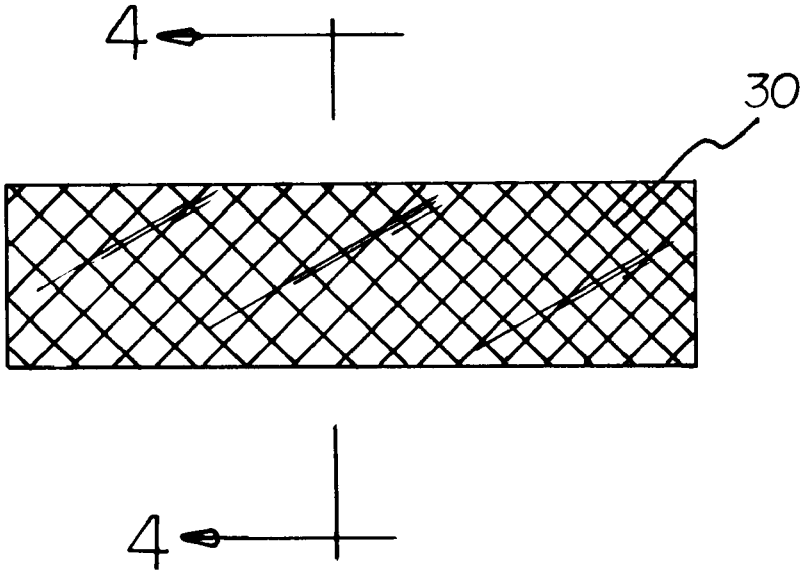
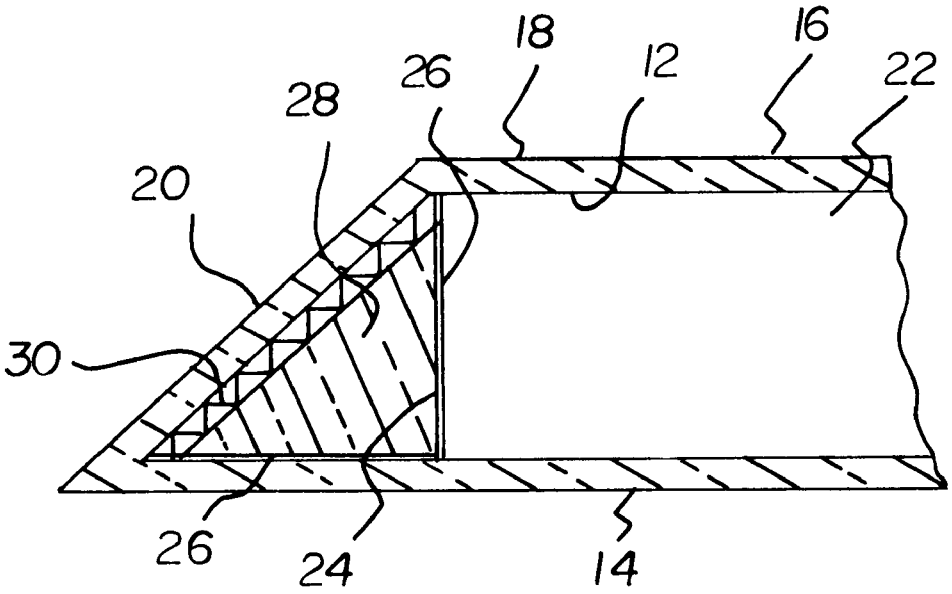
FIG 4

ROAD REFLECTORS WITH TEMPERATURE DEPENDENT COLOR

BACKGROUND OF THE INVENTION

1. Field of the Invention

The present invention relates to highway markers and more particularly pertains to a new road reflectors with temperature dependent color for alerting a driver of a possible icy road condition.

2. Description of the Prior Art

The use of highway markers is known in the prior art. More specifically, highway markers heretofore devised and utilized are known to consist basically of familiar, expected and obvious structural configurations, notwithstanding the myriad of designs encompassed by the crowded prior art which have been developed for the fulfillment of countless objectives and requirements.

Known prior art highway markers include U.S. Pat. No. 5,419,651; U.S. Pat. No. 4,234,264; U.S. Pat. No. 4,919,983; U.S. Pat. No. 3,954,346; U.S. Pat. No. 5,302,048; and U.S. Pat. Des. 305,673.

In these respects, the road reflectors with temperature dependent color according to the present invention substantially departs from the conventional concepts and designs of the prior art, and in so doing provides an apparatus primarily developed for the purpose of alerting a driver of a possible icy road condition.

SUMMARY OF THE INVENTION

In view of the foregoing disadvantages inherent in the known types of highway markers now present in the prior art, the present invention provides a new road reflectors with temperature dependent color construction wherein the same can he utilized for alerting a driver of a possible icy road condition.

The general purpose of the present invention, which will be described subsequently in greater detail, is to provide a new road reflectors with temperature dependent color apparatus and method which has many of the advantages of the highway markers mentioned heretofore and many novel features that result in a new road reflectors with temperature dependent color which is not anticipated, rendered obvious, suggested, or even implied by any of the prior art highway markers, either alone or in any combination thereof.

To attain this, the present invention generally comprises a rigid transparent housing having a square bottom face and a top face with a central square extent and a pair of beveled end extents integrally coupled between the central extent of the top face and the bottom face. A pair of side extents integrally is coupled between side edges of the top and bottom faces to define an interior space. For maintaining the shape of the transparent housing, a rigid rectilinear block is situated therein. The block is equipped with a top face and a bottom face each with a surface area equal to that of the central square extent of the top face of the transparent housing. As such, the block defines a pair of prism shaped compartments within the transparent housing. Situated within the interior space of the transparent housing are reflective layers which line a bottom and rear surface of each of the prism shaped compartments. The bottom and rear surfaces are defined by a portion of the bottom face of the transparent housing and a side face of the block, respectively. Finally, a transparent thermochromatic material is situated within the prism shaped compartments for changing a color of light reflected off of the reflective layers upon a surrounding temperature dropping below a predetermined amount.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new road reflectors with temperature dependent color apparatus and method which has many of the advantages of the highway markers mentioned heretofore and many novel features that result in a new road reflectors with temperature dependent color which is not anticipated, rendered obvious, suggested, or even implied by any of the prior art highway markers, either alone or in any combination thereof.

It is another object of the present invention to provide a new road reflectors with temperature dependent color which may be easily and efficiently manufactured and marketed.

It is a further object of the present invention to provide a new road reflectors with temperature dependent color which is of a durable and reliable construction.

An even further object of the present invention is to provide a new road reflectors with temperature dependent color which is susceptible of a low cost of manufacture with regard to both materials and labor, and which accordingly is then susceptible of low prices of sale to the consuming public, thereby making such road reflectors with temperature dependent color economically available to the buying public.

Still yet another object of the present invention is to provide a new road reflectors with temperature dependent color which provides in the apparatuses and methods of the prior art some of the advantages thereof, while simultaneously overcoming some of the disadvantages normally associated therewith.

Still another object of the present invention is to provide a new road reflectors with temperature dependent color for alerting a driver of a possible icy road condition.

Even still another object of the present invention is to provide a new road reflectors with temperature dependent color that includes a highway marker. A thermochromatic material is mounted on the marker for changing colors in response to a change in temperature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new road reflectors with temperature dependent color according to the present invention.

FIG. 2 is a perspective view of the present invention.

FIG. 3 is an end view of the present invention.

FIG. 4 is a cross-sectional view of the present invention.

DESCRIPTION OF THE PREFERRED EMBODIMENT

With reference now to the drawings, and in particular to FIGS. 1 through 4 thereof, a new road reflectors with temperature dependent color embodying the principles and concepts of the present invention and generally designated by the reference numeral 10 will be described.

The present invention, designated as numeral 10, includes a rigid transparent housing 12 having a square bottom face 14 and a top face 16 with a central square extent 18 and a pair of beveled end extents 20 integrally coupled between the central extent of the top face and the bottom face. A pair of side extents integrally is coupled between side edges of the top and bottom faces to define an interior space.

For maintaining the shape of the transparent housing, a rigid rectilinear block 22 is situated therein. The block is equipped with a top face and a bottom face each with a surface area equal to that of the central square extent of the top face of the transparent housing. As such, the block defines a pair of prism shaped compartments 24 within the transparent housing.

Situated within the interior space of the transparent housing are rectangular reflective layers 26 which line a bottom and rear surface of each of the prism shaped compartments. The bottom and rear surfaces are defined by a portion of the bottom face of the transparent housing and a side face of the block, respectively.

Finally, a transparent thermochromatic material 28 is situated within the prism shaped compartments for changing a color of light reflected off of the reflective layers upon a surrounding temperature dropping below a predetermined amount of about 32 degrees. As an option, a light manipulating layer 30 may be situated between the beveled side extent of the top face of the transparent housing and the thermochromatic material for dispersing and/or diffracting the reflected light.

In the preferred embodiment, the marker is mounted in direct contact with a road for indicating a freezing condition which may result in ice thereon. It should be noted that the marker may take the form of other various shapes and further be mounted above the ground or on a sign adjacent to a highway.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A thermochromatic road marker reflector comprising, in combination:

a rigid transparent housing having a square bottom face, a top face with a central square extent and a pair of beveled end extents integrally coupled between the central extent of the top face and the bottom face, and a pair of side extents integrally coupled between side edges of the top and bottom faces to define an interior space;

a rigid rectilinear block with a top face and a bottom face each with a surface area equal to that of the central square extent of the top face of the transparent housing thereby defining prism shaped compartments;

reflective layers situated within the interior space of the transparent housing and lining a bottom and rear surface of each of the prism shaped compartments which are defined by a portion of the bottom face of the transparent housing and a side face of the block, respectively;

a transparent thermochromatic material situated within the prism shaped compartments for changing a color of light reflected off of the reflective layers upon a surrounding temperature dropping below a predetermined amount of about 32 degrees Fahrenheit; and a light manipulating layer situated between each end extent of the top face of the transparent housing and the thermochromatic material within each of the prism shaped compartments for dispersing the reflected light.

2. In combination, a thermochromatic road marker reflector system and a road with markers each having a predetermined width, a predetermined length and a pair of ends, the system comprising:

a rigid transparent housing mounted on each end of each marker of the road and having a width equal to that of the marker, each housing having a square bottom face, a top face with a central square extent and a pair of beveled end extents integrally coupled between the central extent of the top face and the bottom face, and a pair of side extents integrally coupled between side edges of the top and bottom faces to define an interior space;

a rigid rectilinear block with a top face and a bottom face each with a surface area equal to that of the central square extent of the top face of the transparent housing thereby defining prism shaped compartments;

reflective layers situated within the interior space of the transparent housing and lining a bottom and rear surface of each of the prism shaped compartments which are defined by a portion of the bottom face of the transparent housing and a side face of the block, respectively;

a transparent thermochromatic material situated within the prism shaped compartments for changing a color of light reflected off of the reflective layers upon a surrounding temperature dropping below a predetermined amount of about 32 degrees Fahrenheit; and a light manipulating layer situated between each end extent of the top face of the transparent housing and the thermochromatic material within each of the prism shaped compartments for dispersing the reflected light.

* * * * *